US005568676A

United States Patent [19]

Freeman

[11] Patent Number: 5,568,676

[45] Date of Patent: Oct. 29, 1996

[54] END RELEASE BUCKLE

[75] Inventor: Keith H. Freeman, Cicero, Ind.

[73] Assignee: Indiana Mills and Manufacturing, Inc., Westfield, Ind.

[21] Appl. No.: 400,360

[22] Filed: Mar. 8, 1995

[51] Int. Cl.[6] ..... A44B 11/25

[52] U.S. Cl. ..... 24/641; 24/645

[58] Field of Search ..... 24/641, 642, 640, 24/645, 651; 297/468

[56] References Cited

U.S. PATENT DOCUMENTS

| | | | |
|---|---|---|---|
| 4,069,557 | 1/1978 | Loomba | 24/641 |
| 4,382,320 | 5/1983 | Yamamura . | |
| 4,385,425 | 5/1983 | Tanaka et al. . | |
| 4,388,746 | 6/1983 | Krautz et al. . | |
| 4,527,317 | 7/1985 | Straszewski et al. . | |
| 4,543,693 | 10/1985 | Cunningham . | |
| 4,876,772 | 10/1989 | Anthony et al. . | |
| 4,942,649 | 7/1990 | Anthony et al. . | |

FOREIGN PATENT DOCUMENTS

| | | | |
|---|---|---|---|
| 111332 | 8/1984 | European Pat. Off. | 24/641 |
| 2166187 | 4/1986 | United Kingdom | 24/640 |

*Primary Examiner*—Peter M. Cuomo
*Assistant Examiner*—Hanh V. Tran
*Attorney, Agent, or Firm*—Woodard, Emhardt, Naughton Moriarty & McNett

[57] ABSTRACT

An end release buckle. A buckle frame has a pivotally mounted pawl for lockingly engaging a buckle tongue. The pawl is urged to a locking position by a pawl spring and is released by an end release button having a ramp surface contacting and pivoting the pawl. A tongue ejector is slidably mounted within the frame and is normally urged over the pawl by an ejector spring holding the pawl in an unlocked position. The ejector moves apart from the pawl upon insertion of the tongue. A separate member slidably mounted within the frame is forced forwardly towards the buckle entrance by the button and the button spring upon insertion of the tongue with the member sliding beneath the locked pawl.

17 Claims, 4 Drawing Sheets

END RELEASE BUCKLE

BACKGROUND OF THE INVENTION

1. Field of the Invention:

This invention is in the field of buckles utilized in restraint systems and more specifically, buckles of the end release type.

2. Description of the Prior Art:

In the commonly owned U.S. Pat. Nos. 4,876,772 and 4,942,649, there is disclosed an end release buckle having a spring biased pawl urged apart from the buckle frame to lockingly engage a tongue. A slidable button is movable to release the button from the tongue. The buckle includes a spring biased tongue ejector slidable over the pawl when the buckle is unlocked from the tongue.

Additional U.S. patents disclosing end release buckles include the U.S. Pat. Nos. 4,388,746 issued to Krautz et al. and 4,527,317 issued to Straszewski et al. Similar types of buckles including spring biased pawls held in position via the buckle button and other structure include the U.S. Pat. Nos. 4,382,320 issued to Yamamura; 4,385,425 issued to Tanaka et al. and 4,543,693 issued to Cunningham. The aforementioned Tanaka et al patent discloses a spring biased lock engaging means which slips beneath the pawl.

Despite the prior end release buckles, there is still a need for an end release buckle which is less expensive to produce and easier to assemble. Disclosed herein is a sub assembly which may be easily assembled to the buckle main frame with the sub assembly including a pair of springs for urging the buckle button and tongue ejector to the proper positions. The buckle further includes a slidable member for cooperating with the buckle button and pawl for positioning thereof.

SUMMARY OF THE INVENTION

One embodiment of the present invention is an end release seat belt buckle lockable with a tongue comprising a main frame with a bottom wall and side walls integrally joined together and forming an entrance to receive the tongue. A pawl is movably mounted atop the bottom wall and includes an upwardly projecting lock lockable with the tongue and a rearwardly projecting extension. A first spring is positioned between the pawl and the bottom wall and is normally operable to urge the pawl to move positioning the pawl in an upward position but yieldable to allow the pawl to move positioning the pawl in a downward position. The pawl when in the upward position forms a space between the pawl and the bottom wall. An end release button is slidably mounted to the main frame and has an outer position when the pawl is locked with the tongue and an inward position when the pawl is unlocked. The button contacts the extension when moving from the outer position to the inward position and positions the pawl in the downward position. An ejector frame is fixedly mounted to the main frame. A second spring is positioned between the ejector frame and the button and is operable to normally force the button to the outer position but yieldable to allow the button to move to the inward position. A tongue ejector is slidably mounted to the ejector frame. A member has a main body slidable upon the bottom wall and includes a proximal end connected to the button and movable therewith and a distal end movable into the space between the pawl and the bottom wall when the button is in the outer position limiting movement of the pawl toward the bottom wall but movable out of the space and apart from the pawl when the button is in the inward position.

It is an object of the present invention to provide a new and improved end release buckle.

A further object of the present invention is to provide an end release buckle which is easier to assemble and less expensive to manufacture.

In addition, it is an object of the present invention to provide an end release buckle with a slidable member for positioning the buckle button.

Related objects and advantages of the present invention will be apparent in the following description.

DESCRIPTION OF THE PREFERRED EMBODIMENT

Figure 1:
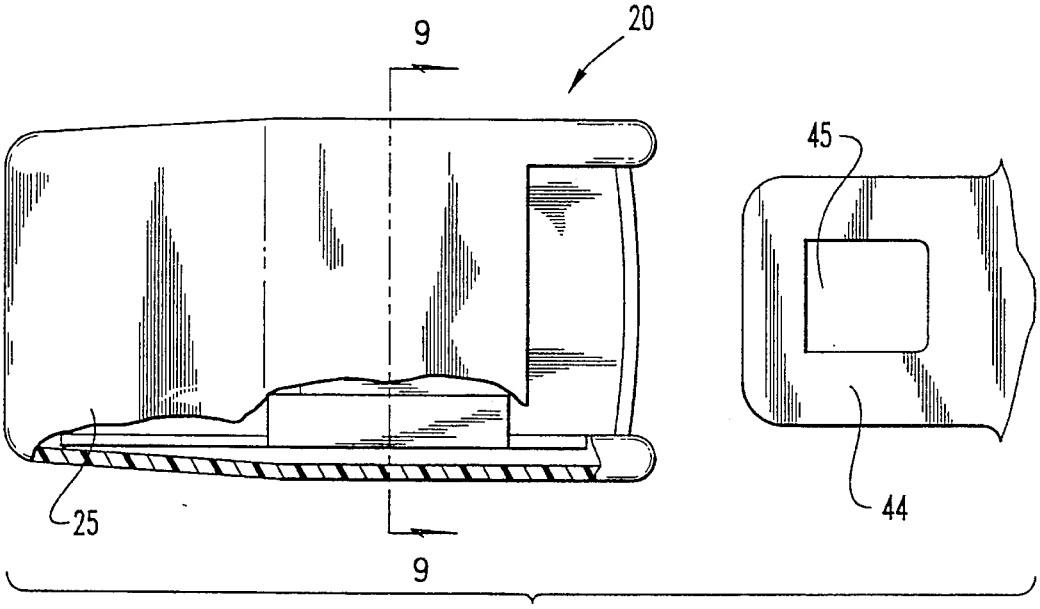
FIG. 1 is a fragmentary top view of an end release buckle with associated tongue.
Figure 2:
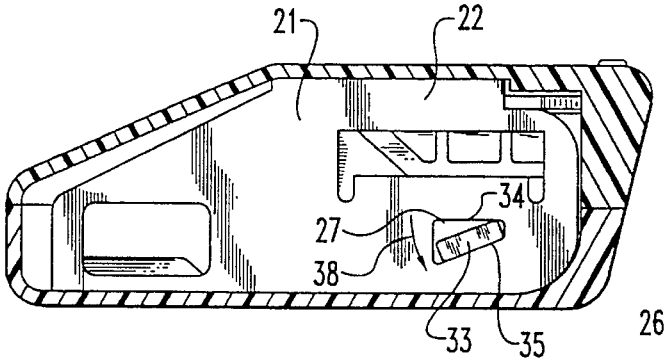
FIG. 2 is a side view of the buckle with a portion of the outer housing removed.
Figure 3:
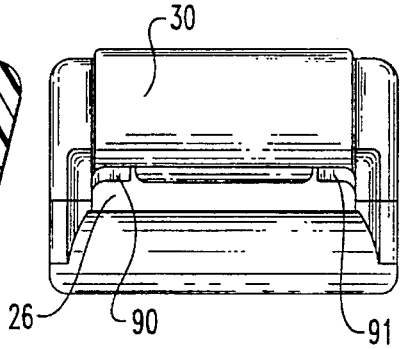
FIG. 3 is an end view of the buckle.
Figure 4:
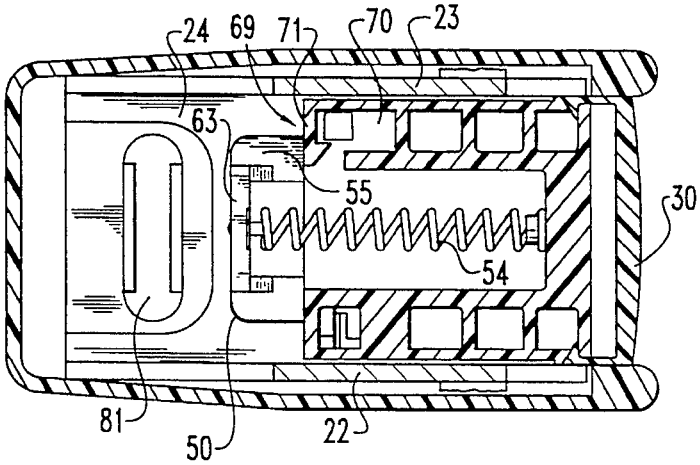
FIG. 4 is a top view of the buckle with a portion of the outer housing removed.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 9:
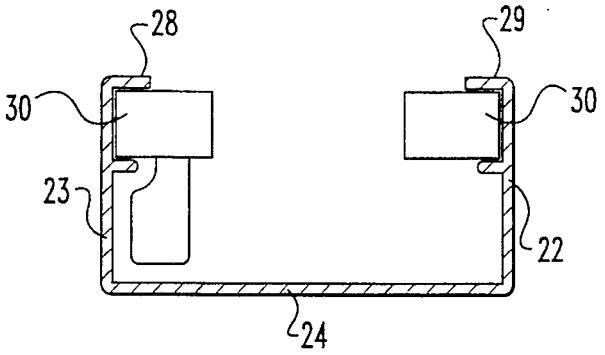
FIG. 9 is a cross sectional view taken along the line 9—9 of FIG. 1 and viewed in the direction of the arrows.

Referring now more particularly to FIGS. 1–4, there is shown an end release buckle 20 having a main frame 21 with a pair of side walls 22 and 23 integrally joined to a bottom wall 24 and extending perpendicularly therefrom. A housing 25 encloses the frame and mates with a slide button 30 forming a tongue entrance 26. The top ends 28 and 29 (FIG. 9) respectively of side walls 23 and 22 turn inwardly forming a channel in which button 30 (FIG. 4) slides. A pair of tabs 90 and 91 (FIG. 3) are integrally attached respectively to frame side walls 22 and 23 and project inwardly providing a seat upon which button 30 slides being held thereon by the inwardly extending tabs 28 and 29 of the same side walls.

A locking pawl 31 (FIG. 5) is pivotally mounted atop bottom wall 24 with leaf spring 32 located therebetween. Hole 81 (FIG. 4) extends through the bottom wall of the frame as well as the bottom wall of housing 25 to facilitate the attachment of the buckle to a web.

Figure 5:
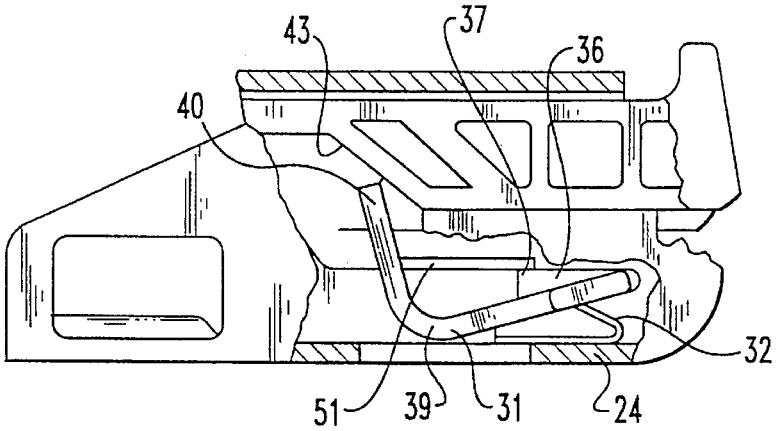
FIG. 5 is a fragmentary side view illustrating the buckle in an unlocked position.
Figure 13:
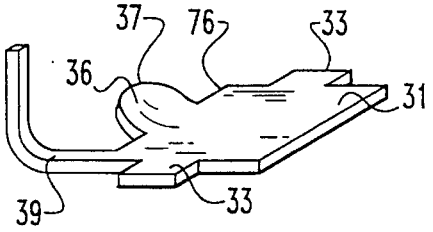
FIG. 13 is a perspective view of the buckle pawl.

A pair of wedge shaped holes 27 (FIG. 2) are provided in side walls 22 and 23 to pivotally receive the opposite ends 33 of pawl 31. The pawl extends across entrance 26 from side wall 22 to side wall 23 with one such end 33 shown in FIG. 2 as extending through hole 27 of side wall 22, it being understood that the opposite end of pawl 31 extends through a similar hole provided in side wall 23. Holes 27 provided in the side wall are identical each having a top horizontally extending edge 34 and a bottom edge 35 sloping upwardly towards edge 34 as it extends toward the entrance 26 of the buckle. Pawl 31 (FIG. 13) has a locking projection 36 having an aft end 37 located in its most upward position when ends 33 are horizontal and contactingly extend the length of edge 34 of holes 27. By pivoting pawl 31 in the counterclockwise direction of arrow 38 (FIG. 2) the outer ends 33 of the pawl are pivoted downward to be spaced apart from edge 34 of the hole resting atop the upwardly slanting edge 35 thereby positioning the top distal end 37 of projection 36 in a downward position as shown in FIG. 5.

Pawl 31 (FIG. 6) has a rearwardly extending leg 39 with the distal portion 40 of leg 39 extending upwardly into cavity 41 of button 30. Cavity 41 is formed by the vertical rear wall 42 of button 30 and an upwardly slanting wall 43 of the button. When button 30 is in its most outer position, wall 42 abuts distal end portion 40 of the pawl forcing the distal end portion of the pawl to assume a vertical position with pawl ends 33 contacting hole edges 34 and with the top edge 37 of locking projection 36 being located in the most upward position. By pushing button 30 to the left as viewed in FIG. 6 to its most inward position, distal end portion 40 of the pawl contacts wall 43 thereby pivoting the pawl in the counterclockwise direction of arrow 38 (FIG. 2) with the pawl ends 33 contacting hole edges 35 and forcing projection 36 to assume a horizontal position with edge 37 of the locking projection being located in the most downward position. Spring 32 is operable to normally urge the pawl to the locked position depicted in FIG. 6 but is yieldable to allow the pawl to pivot to the unlocked position illustrated in FIG. 5.

Figure 10:
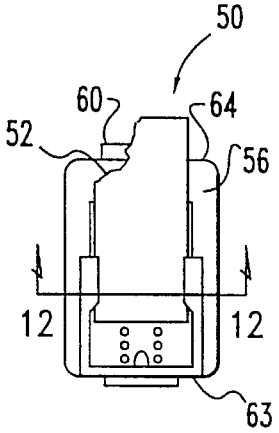
FIG. 10 is a top view of the ejector and button spring frame.
Figure 11:
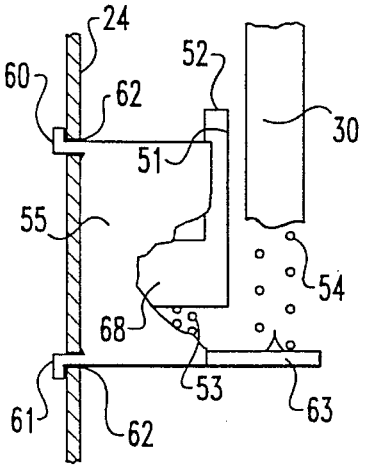
FIG. 11 is a fragmentary side view of the frame of FIG. 10.
Figure 12:
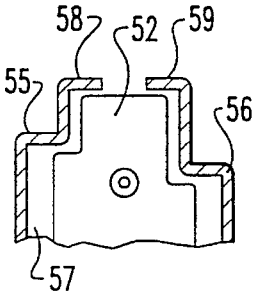
FIG. 12 is a fragmentary cross sectional view taken along the line 12—12 of FIG. 10 and viewed in the direction of the arrows.

A secondary frame 50 (FIG. 10) is mounted to the bottom wall 24 (FIG. 11) and slidably holds a tongue ejector 52 and associated helical spring 53 as well as a second spring 54 for urging button 30 outwardly. Secondary frame 50 includes a pair of side walls 55 and 56 (FIG. 12) and end walls 63 and 64 (FIG. 10) integrally joined together but spaced apart forming a cavity 57 slidably holding tongue ejector 52. Ejector 52 includes a main body 68 held captive in cavity 57 by the inward turned top ends 58 and 59 respectively of side walls 55 and 56. A ledge 51 projects outwardly and is integrally attached to main body 68. Spring 53 is operable to urge ledge 51 outwardly over pawl 31 but is yieldable to allow the tongue when inserted into entrance 26 to contact ledge 51 and force the ejector rearwardly apart from the pawl.

Walls 63 and 64 include a pair of plastic feet 60 and 61 integrally attached thereto. Feet 60 and 61 extend through apertures 62 provided in bottom wall 24. Feet 60 and 61 mount secondary frame 50 to the buckle main frame. The feet are elastic allowing frame 50 to be snap mounted to bottom wall 24. That is, one foot 60 may be inserted through one of the apertures 62 with the remaining foot 61 forced slightly to the other foot until it fits through the remaining aperture with the feet then spreading and holding the secondary frame to the buckle main frame.

Rear wall 63 is integrally attached to side walls 55 and 56 and extends upwardly holding spring 54 which extends forwardly towards the entrance against button 30. Spring 54 is operable to normally urge the button outwardly but is yieldable to allow the button to be depressed into the buckle main body.

Figure 7:
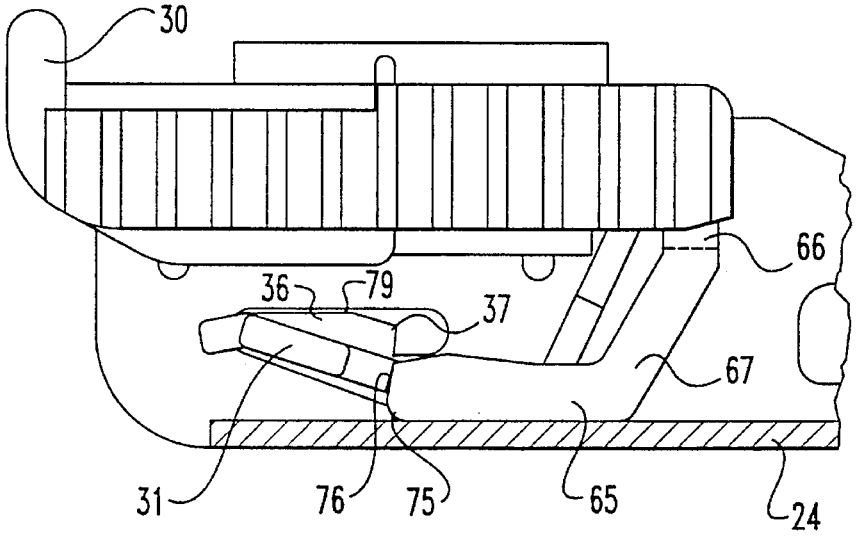
FIG. 7 is a fragmentary side view of the buckle with the pawl in the unlocked position.
Figure 8:
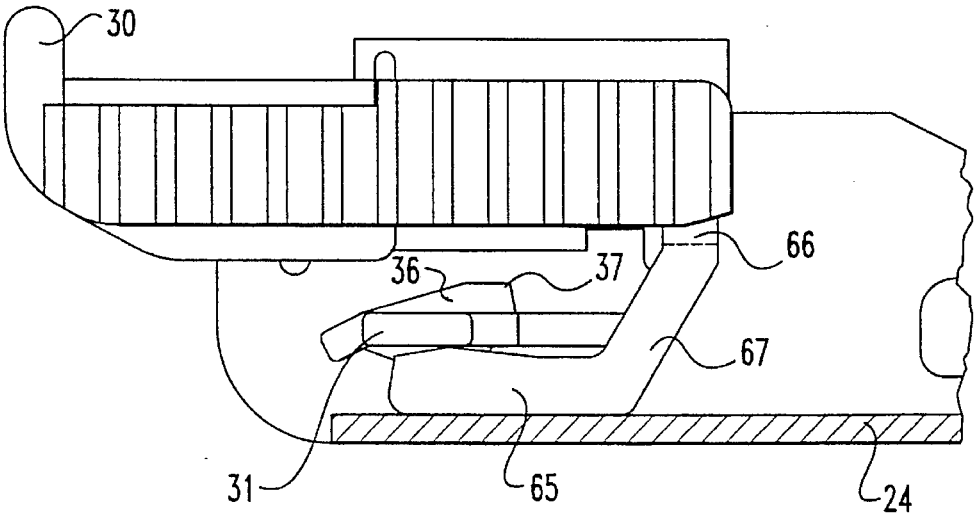
FIG. 8 is a fragmentary side view of the buckle with the pawl in a locked position.

A generally L-shaped member 67 (FIG. 7) is slidably mounted atop bottom wall 24 between a channel 69 (FIG. 4) formed by the spacing of buckle frame side wall 23 and secondary frame side wall 55. FIGS. 7 and 8 are fragmented with ejector frame 50 and associated springs not shown to more clearly illustrate member 67. Member 67 includes a horizontally extending leg 65 integrally joined to a vertically extending leg 66 which extends up into cavity 70 (FIG. 4) of button 30. Member 67 is held captive between main frame side wall 23 (FIG. 4) and secondary frame side wall 55 and is movable with button 30. Notably, member 67 is directly connected to button 30 without a spring therebetween. The rear wall 71 (FIG. 4) of button 30 is elastic and may be pivoted slightly outward to allow for insertion of leg 66 into cavity 70. The distal end of wall 71 is hook shaped to facilitate the retaining of leg 66.

Figure 6:
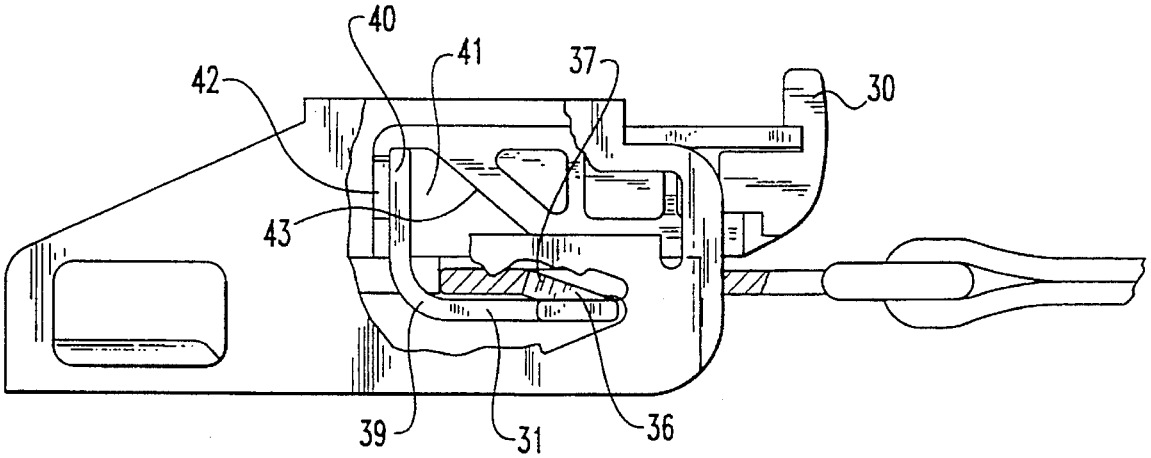
FIG. 6 is a fragmentary side view with the buckle shown locked to a tongue.

In operation, with tongue 44 (FIG. 1) separated from buckle 20, the buckle is in an unlocked condition. The top surface of projection 36 (FIG. 5) extends horizontally and lies beneath and abuts against the bottom surface of ledge 51 with spring 53 urging the tongue ejector outwardly over the pawl. Ears 33 (FIG. 2) rest against slanted edges 35. Button 30 is located in an inward position (FIG. 7) with the forward end 75 of the slidable member 67 being located at and against the rear edge 76 of pawl 31. The upper leg 66 of member 67 holds button 30 in the inward position compressing button spring 54. When tongue 44 (FIG. 1) is inserted into entrance 26, the leading edge of the tongue will contact the leading edge of tongue ejector ledge 51 forcing the tongue ejector rearwardly compressing ejector spring 53. Continued inward movement of the tongue will eventually position ledge 51 apart from pawl 31 locating tongue aperture 45 (FIG. 1) immediately over projection 36 and allowing pawl spring 32 (FIG. 5) to force the pawl projection 36 upwardly and through aperture 45 thereby locking the tongue to the buckle as shown in FIG. 6. Simultaneously, rear edge 76 (FIG. 7) of pawl 31 will move upwardly and apart from the forward end 75 of member 67 allowing button spring 54 to force button 30 to the outward position illustrated in FIG. 8 thereby sliding member 67 forwardly positioning leg 65 beneath the main body of pawl 31. In order to unlock the tongue from the buckle, button 30 is depressed from the position illustrated in FIG. 8 to the position illustrated in FIG. 7 thereby contacting wall 43 against the distal end 40 of pawl extension 39 pivoting the pawl in a counterclockwise direction from the position illustrated in FIG. 6 to the position illustrated in FIG. 5 thereby moving pawl 31 out of tongue aperture 45. Simultaneously, leg 66 of member 67 will be forced rearwardly by button 30 thereby sliding leg 65 of member 67 from beneath pawl 31 from the position illustrated in FIG. 8 to the position illustrated in FIG. 7 while compressing pawl spring 32. Once the top surface 79 (FIG. 7) of projection 36 has assumed a position parallel with the tongue, the tongue will be elected as ledge 51 urged outwardly by spring 53 passes atop surface 79 forcing the tongue outwardly while holding the pawl in the unlocked position.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An end release seat belt buckle lockable with a tongue comprising:

a main frame with a bottom wall and side walls integrally joined together and forming an entrance to receive said tongue;

a pawl movably mounted atop said bottom wall and including an upwardly projecting lock lockable with said tongue and a rearwardly projecting extension;

a first spring positioned between said pawl and said bottom wall and normally operable to urge said pawl to move positioning said pawl in an upward position but yieldable to allow said pawl to move positioning said pawl in a downward position, said pawl when in said upward position forming a space between said pawl and said bottom wall:

an end release button slidably mounted to said main frame and having an outer position when said pawl is locked with said tongue and an inward position when said pawl is unlocked with said tongue with said button contacting said extension when moving from said outer position to said inward position and moving said pawl positioning said pawl in said downward position;

an ejector frame fixedly mounted to said main frame;

a second spring positioned between said ejector frame and said button operable to normally force said button to said outer position but yieldable to allow said button to move to said inward position;

a tongue ejector slidably mounted to said ejector frame; and, a member having a main body slidable upon said bottom wall and including a proximal end connected to said button and movable therewith and a distal end movable into said space between said pawl and said bottom wall when said button is in said outer position limiting movement of said pawl toward said bottom wall but movable out of said space and apart from said pawl when said button is in said inward position.

2. The end release buckle of claim 1 and further comprising:

a third spring positioned between said ejector frame and said tongue ejector operable to normally force said tongue ejector atop said pawl when said button is in said inward position and said pawl is in said downward position but yieldable to allow said tongue ejector to move apart from said pawl when said tongue is inserted into said entrance atop said pawl.

3. The end release buckle of claim 2 wherein:

said tongue ejector when atop said pawl holding said pawl in said downward position eliminating said space limiting movement of said distal end of said member therein with said proximal end of said member holding said button in said inward position.

4. The end release buckle of claim 3 wherein:

said ejector frame and said main frame forming a channel in which said member is slidable, said member includes an L-shaped configuration with said distal end of said member facing toward said pawl and said entrance and said proximal end extending upwardly from said bottom wall into said button.

5. The end release buckle of claim 4 wherein: said member is directly connected to said button and is moved only by and with said button.

6. The end release buckle of claim 1 wherein:

said ejector frame includes elastic feet extendable through and lockable with said bottom wall with said elastic feet snapping into locking engagement with said bottom wall when said ejector frame is mounted to said bottom wall.

7. The end release buckle of claim 2 wherein:

said tongue ejector includes a main body and a ledge integrally connected thereto, said ledge extends toward said entrance and atop said pawl when said pawl is in said downward position, said ejector frame includes a cavity in which said main body is positioned, and said third spring is positioned between said main body and said ejector frame.

8. An end release seat belt buckle lockable with a tongue comprising:

a main frame with a bottom wall and side walls forming an entrance to receive said tongue;

a pawl pivotably mounted atop said bottom wall and including a rearwardly projecting extension;

first spring means positioned between said pawl and said bottom wall and normally operable to urge said pawl to move positioning said pawl in all upward position but yieldable to allow said pawl to move positioning said pawl in a downward position;

end release means slidably mounted to said main frame and having a first position when said pawl is locked with said tongue and a second position when said pawl is unlocked with said tongue with said end release means contacting said extension when moving from said first position to said second position and moving said pawl positioning said pawl in said downward position;

second spring means contacting said end release means operable to normally force said end release means to said first position but yieldable to allow said end release means to move to said second position; and, movable means having a main body slidable upon said bottom wall and including a proximal end directly connected to said end release means and a distal end movable between said pawl and said bottom wall when said end release means is in said first position limiting movement of said pawl toward said bottom wall but movable out of said space and apart from said pawl when said end release means is in said second position, said movable means being movable only by said end release means.

9. The end release buckle of claim 8 and further comprising:

eject means lockably mounted to said frame; and, third spring means contacting said eject means operable to normally force said eject means atop said pawl when said end release means is in said second position and said pawl is in said downward position but yieldable to allow said eject means to move apart from said pawl when said tongue is inserted into said entrance atop said pawl.

10. The end release buckle of claim 9 wherein:

said eject means when atop said pawl holding said pawl in said downward position limiting movement of said distal end of said movable means therein with said proximal end of said movable means holding said end release means in said second position.

11. The end release buckle of claim 9 wherein:

said eject means includes elastic feet extendable through and lockable with said bottom wall with said elastic feet snapping into locking engagement with said bottom wall when said eject means is mounted to said bottom wall.

12. An end release buckle lockable with a tongue comprising:

a one piece main frame with a bottom wall and side walls integrally connected together forming a tongue entrance;

a pawl pivotally mounted to said side walls atop said bottom wall;

a pawl spring positioned between said bottom wall and said pawl and operable to normally urge said pawl to an upward position but yieldable to allow said pawl to move to a downward position;

a secondary frame mounted atop said bottom wall;

a tongue ejector slidably mounted to said secondary frame and laving a ledge movable over and against said pawl holding said pawl ill said downward position until the tongue is inserted into said entrance contacting said ledge and forcing said ledge apart from said pawl;

an end release button slidably mounted to said main frame between said bottom wall and said side walls, said button located in a first position when said tongue ejector holds said pawl in said downward position with said button located in a second position when said tongue is locked to said pawl and said tongue ejector is positioned apart from said pawl; and, a member having an L-shaped configuration with a first leg slidably over said bottom wall and between said bottom wall and said pawl when said button is in said second position and a second leg extending upwardly therefrom into direct engagement with said button.

13. The buckle of claim 12 wherein:

said first leg slidable apart from between said bottom wall and said pawl when said button moves from second position to said first position and with said member moved by direct movement of said button.

14. The buckle of claim 13 wherein:

said secondary frame and said main frame form a channel in which said member is slidable limiting movement of said member only to and from said entrance.

15. The buckle of claim 14 and further comprising:

a button spring positioned between said button and said secondary frame operable to normally force said button to said second position but yieldable to allow said button to move to said first position; and, an eject spring positioned between said tongue ejector and said secondary frame operable to normally force said tongue ejector atop said pawl but yieldable to allow said tongue ejector to move apart from said pawl.

16. The buckle of claim 15 wherein:

said secondary frame includes elastic feet extendable through said main frame snap mounting said secondary frame to said main frame.

17. The buckle of claim 16 wherein:

said eject spring is positioned between said bottom wall of said main frame and said button spring.

* * * * *

UNITED STATES PATENT AND TRADEMARK OFFICE

CERTIFICATE OF CORRECTION

PATENT NO. : 5,568,676

DATED : October 29, 1996

INVENTOR(S) : Keith H. Freeman

It is certified that error appears in the above-identified patent and that said Letters Patent is hereby corrected as shown below:

Column 7, line 25 delete "laving" and insert --having--.
Column 7, line 26 delete "ill" and insert --in--.

Signed and Sealed this

Twenty-second Day of April, 1997

Bruce Lehman

*Attest:*

BRUCE LEHMAN

*Commissioner of Patents and Trademarks*

*Attesting Officer*